US005519986A

United States Patent [19]

Raffit

[11] Patent Number: 5,519,986

[45] Date of Patent: May 28, 1996

[54] GYMNASTIC HARNESSING AND GUIDING APPARATUS FOR A HORSE

[76] Inventor: Michel Raffit, 6, rue Gounod, 75017 Paris, France

[21] Appl. No.: 291,108

[22] Filed: Aug. 16, 1994

[30] Foreign Application Priority Data

Aug. 24, 1993 [FR] France ..... 93 10203

[51] Int. Cl.[6] ..... B68B 1/00

[52] U.S. Cl. ..... 54/71; 54/16

[58] Field of Search ..... 54/16, 71

[56] References Cited

U.S. PATENT DOCUMENTS

| | | | |
|---|---|---|---|
| 501,789 | 7/1893 | Hoss | 54/36 |
| 1,006,203 | 10/1911 | Gallagher | 54/16 |
| 3,104,507 | 9/1963 | Blankenship | 54/71 |
| 5,349,805 | 9/1994 | Brown | 54/71 X |

FOREIGN PATENT DOCUMENTS

| | | |
|---|---|---|
| 376484 | 10/1907 | France . |
| 984652 | 9/1951 | France . |

*Primary Examiner*—Robert P. Swiatek
*Attorney, Agent, or Firm*—Brumbaugh, Graves, Donohue & Raymond

[57] ABSTRACT

A gymnastic harnessing and guiding apparatus for a horse comprises at least one stimulation member adapted to be placed at a lower part of the horse's neck, and a recalling member for recalling the stimulation member upwardly and rearwardly. The recalling member further comprises a flexible strap, a headstall comprising first and second head-recalling members, respectively placed on each one of its lateral ends, a breast-recalling member, and first and second shoulder fixing points, respectively configured for placement on each side of the horse between the shoulders and the withers. The stimulation member is designed to exert an annoying stimulation at the lower part of the horse's neck, in a region situated between the third cervical vertebra and the first dorsal vertebra, as soon as the position of the horse's head and neck departs from a target position to beyond a predetermined lower limit. The stimulation member is placed between the first and second sliding members adapted to be situated on either side of the horse's neck. The flexible strap is joined by a first end to the first shoulder fixing point, and passes successively through the first sliding member, the first head-recalling member, the breast-recalling member, the second head-recalling member, and the second sliding member, and is joined to the second shoulder fixing point by its second end.

12 Claims, 5 Drawing Sheets

GYMNASTIC HARNESSING AND GUIDING APPARATUS FOR A HORSE

BACKGROUND OF THE INVENTION

The present invention relates to a gymnastic harnessing and guiding apparatus for a horse.

A large number of "rein arrangement" systems are known for dressage, such as the systems called "Gogue" or "Chambon", devised with a view to imposing on the horse a predetermined posture which will dominate it, and to rectifying a bad posture or obliging the horse to take a gymnastic work position intended to stretch certain muscles or to develop others.

Such systems, which are all joined to the horse's mouth or nose, are meant to oblige the horse to bend or to bow its head which it tends to carry too high when struggling against the hand, this curving its back in.

The "Gogue rein arrangement" essentially consists in a triangulate breast-neck-mouth system, closed over itself (independent rein arrangement) or over the hand (control rein arrangement) and sliding over headstall pulleys and in the rings of the snaffle. It presses on the neck and on the mouth of the horse and its effect is either to lower the head and the back of the neck, or to bend the head on the neck. The effect of this rein arrangement irresistibly leads the horse towards a downwards extension in order to avoid the high bending of the rein arrangement. When the horse has accepted it, said horse then indulges into deep inclinations of the head, and it is often difficult to make it up again.

It is therefore obvious that such a rein arrangement involves perverted effects which can even be dangerous when the horse is mounted by an inexperienced rider.

Moreover, the "Gogue rein arrangement" acts mainly by pulling on the bit when the horse raises its neck or pulls it back. The bending of the head over the neck which the "Gogue" imposes is an artificial one, it compresses the throat and induces the horse to curve its dorsal spine in. This curving in movement hinders the locomotor abilities of the horse and merely accentuates the harmful effects of the rider's weight. Another perverted effect of the "Gogue" system is that it induces the horse to roll its head on the neck, the nose reaching inwards of the vertical.

The "Chambon rein arrangement" joins the horse's mouth to its breast while passing over the back of the neck. The action of this arrangement causes a harsh strain on the horse upon which obedience on the part of the horse is accompanied by a reaction of defence against the bit while the horse holds its head and neck constantly down.

The object of this rein arrangement, contrary to the "Gogue" arrangement, which primarily induces the head to bend over the neck, is above all to obtain a fixed position for re-educating the incurving of the spine by pushing the nose down to the ground. Indeed, this strained posture induces a forced stretching of the muscles and tendons which throws back the neck and incurves the back (thus hindering their development). Moreover, this posture places the horse in a forward sloping position (with its haunches being higher than the withers), thus removing all motor possibility to its hind legs, which are used mainly for preventing the horse from failing than for propelling it.

Another known system, called "Pessoa rein arrangement" which is also coercive, joins the horse's mouth to its hock ligaments passing over a surcingle. Compared with the aforementioned systems, this rein arrangement has the advantage of trying to develop the engaging work of the legs and to develop the back muscles of the horse. It enables galloping work, but is not usable when the horse is mounted. Moreover, this rein arrangement, by setting up a joint between the hock's ligaments and the mouth, imposes a fixedly strained position of said ligaments with respect to the mouth, this preventing the horse from stretching itself.

None of the known rein arrangements really tend to reverse the natural incurving of the horse's spine or to induce said horse to use its spine as a motor element of its locomotion.

SUMMARY OF THE INVENTION

It is the object of the present invention to develop the horse's motor muscle system by using a non-coercive harnessing which induces it to adopt and to keep up during mounted or not mounted work, a dynamic and supporting locomotor posture whatever its gait, and in which slowing down, even in full action, is helped. It is also the object of the invention to bring the horse to place its head and neck in a fixed posture which enables it to move its shoulders powerfully while allowing it maximum of autonomy as regards the permanent control of said posture. Yet another object of the invention is to bring the horse to adopt a type of locomotion which enables it to develop its powerful muscular masses. A final object of the invention is to improve the work of the horse and to make the latter easier to guide, even for an inexperienced rider.

To this effect, according to the invention, the horse's harnessing apparatus comprises at least one stimulation member placed at the lower part of the horse's neck and means for recalling said member upwardly and rearwardly. Said stimulation member is designed to exert an annoying or unpleasant stimulation at the lower part of the horse's neck, in a region situated between the third cervical vertebra and the first dorsal vertebra, just when the position of the horse's neck departs from a target position to beyond a predetermined lower limit.

Thanks to the invention, the effect of the stimulation member is felt as soon as the horse tries to resume a relaxed posture in which the base of the neck goes down either by upward concavity, this urging and raising the head, or by upward convexity, which is accompanied by the lowering of the head towards the ground or by the head rolling around the neck.

The curves of the different parts of the spine being jointed, the resulting posture of the base of the neck spreads from the head to the tail in the manner of a cervico-lumba tensor.

Depending on the stimulation member used, the annoying or unpleasant stimulation can vary from a simple touch to a prick following a pressure or a grip. It causes the vertebrae in question to move back and to rise and as a result it modifies the curve of the spine while correcting the sinking thereof. The slope of the horse's back is lifted up by the opening of the scapulo-humero-radial articular angles, this raising the fore part of the thorax (withers). As to the neck, this is urged forward while the dorsal vertebrae are urged backwards.

Through the recalling means, when the base of the neck has reached beyond a predetermined limit position (downwards convexity), the stimulation member exerts an annoying or unpleasant stimulation upwards and rearwards which, by an avoiding action, leads the horse to move back and to lift the base of its neck (by upward convexity). This pushes the neck towards the vertical of the mouth, which is the expected dynamic posture, and pushes the dorsal vertebrae backwards, which bends the pelvis.

If on the contrary, the horse lowers its head and neck or rolls the latter while lowering it (downwards concavity), it encounters the stimulation member which repeats its annoying or unpleasant action, thus leading the horse to the same avoiding action.

Since the invention only induces the horse, without coercion, to take up an arched posture which the horse adopts instinctively in certain occasions such as a scare, or the crossing of a difficult passage or fighting, its action is not accompanied by any acrobatic posture and it is obvious that contrary to the aforesaid "rein arrangements", it causes no dangerous effects either on the horse or on an inexperienced rider.

According to a first embodiment, advantageously used when the horse works with a lunging rein or on its own, the apparatus comprises first and second neck sliding members on the neck situated on either side of the horse's neck, and between which is placed a stimulation member. The recalling means comprise at least a flexible strap, a headstall having first and second head recalling members respectively placed at each one of its lateral ends, a breast recalling member, and first and second shoulder fixing points on the shoulders respectively placed on each side of the horse, in a region situated between the shoulders and the withers. The strap is joined by a first end, to the first fixing point on the shoulder, then it passes successively through the first sliding member on the neck, through the first head-recalling member, through the breast-recalling member, through the second head-recalling member, and through the second sliding member on the neck, and it is joined to the second fixing point on the shoulder by its second end.

In the case where two straps are used, these are placed on either side of the horse's neck, and they are respectively fixed by their first end to the first and second fixing points on the shoulders and, by their second end, to the fixing point on the breast.

The various recalling members can be fixing members or sliding members. In the latter case, the sliding members on the head can, for example, be constituted by pulleys and the sliding member on the breast can for example be constituted by a ring.

The flexible strap can be constituted by a cord or by any other strap in plastics, leather or elastic material. In this embodiment, the apparatus does not use any elements of saddlery other than a surcingle which enables fastening of the fixing points on the shoulders and breasts. This therefore enables the horse to be equipped with this apparatus in any circumstances, even for long periods. After a short adaptation period, the horse will naturally adopt the posture most comfortable to him, i.e. a target posture in which the stimulation member does not bother him. It can also incline its head sideways without being hindered by the stimulation member.

If a coercive effect is to be added, knowing that the horse is equipped with a bit, the flexible strap can be relayed by first and second sliding members on the bit between the head-recalling member and the breast-recalling member.

The stimulation member can be rigid or flexible, and it can even be equipped, if necessary, with slightly projecting nails in order to cause a pricking sensation if the horse's posture departs too much from the target posture. Generally, a simple strap in leather or other material will be sufficient. A first possibility consists in fixing a strap, whose length can vary between 15 and 25 cm, to the first and second sliding members on the neck. A second possibility consists in using a strap of length varying between 70 and 90 cm and in placing it in triangle fashion by passing it through the first and second sliding members on the neck and through the sliding member on the breast. In this latter case, it is the upper end of the strap which constitutes the stimulation member.

A second embodiment is now presented, which embodiment is advantageously used when the horse is mounted. In this case, the horse is equipped with guiding reins and, in a first variant, the upwards and rearwards recalling means include two straps joined to the reins on either side of the horse's neck. In a second variant, the recalling means comprise two buckles with rings which separate each rein into two adjustable parts, substantially at the level of the horse's neck.

The stimulation member is constituted by at least one portion of a strap placed across the lower part of the horse's neck and equipped with fixing means. The higher the tension applied on the first part of the reins, the more it is exerted on the stimulation member, this relaxing proportionally the action on the bit. However, the reins still have their effect of lateral control since each one recovers a direct coercive effect on the bit as soon as the other is loose.

DESCRIPTION OF THE PREFERED EMBODIMENTS

Figure 1A:
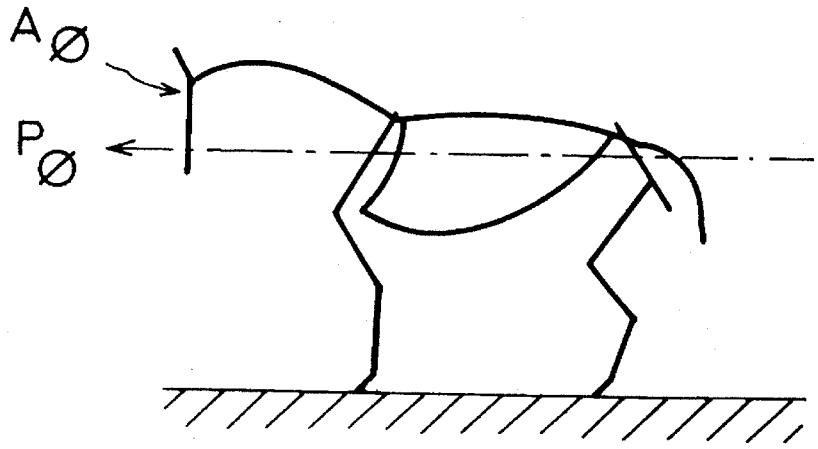
FIG. 1*a* shows diagrammatically the posture of a horse corrected with the apparatus according to the invention.
Figure 1B:
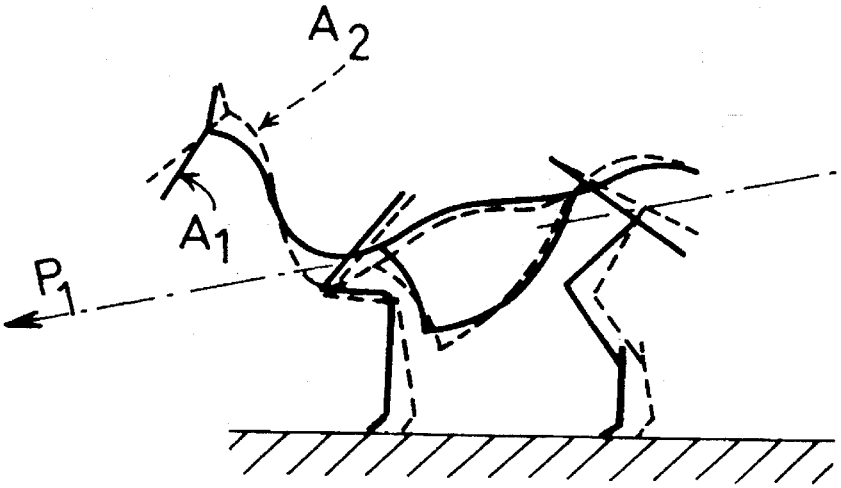
FIG. 1*b* diagrammatically shows the natural posture of a horse and its exaggeration under the rider's weight.

FIG. 1*a* diagrammatically illustrates a horse in target posture A0. It is noted that the last cervical vertebrae and the first dorsal vertebrae are pushed back and lifted. The overall slope of the horse P0 is substantially horizontal. FIG. 1*b* shows, in block lines, the horse in its natural posture A1, in which the back is incurved so that, contrary to FIG. 1*a*, its spine adopts a generally upwardly concave position. The slope P1 of this horse is downwards and frontwards with respect to the horizontal. This figure indicates in dash and dot lines the position A2 exaggerated under the effect of the rider's weight.

Figure 2:
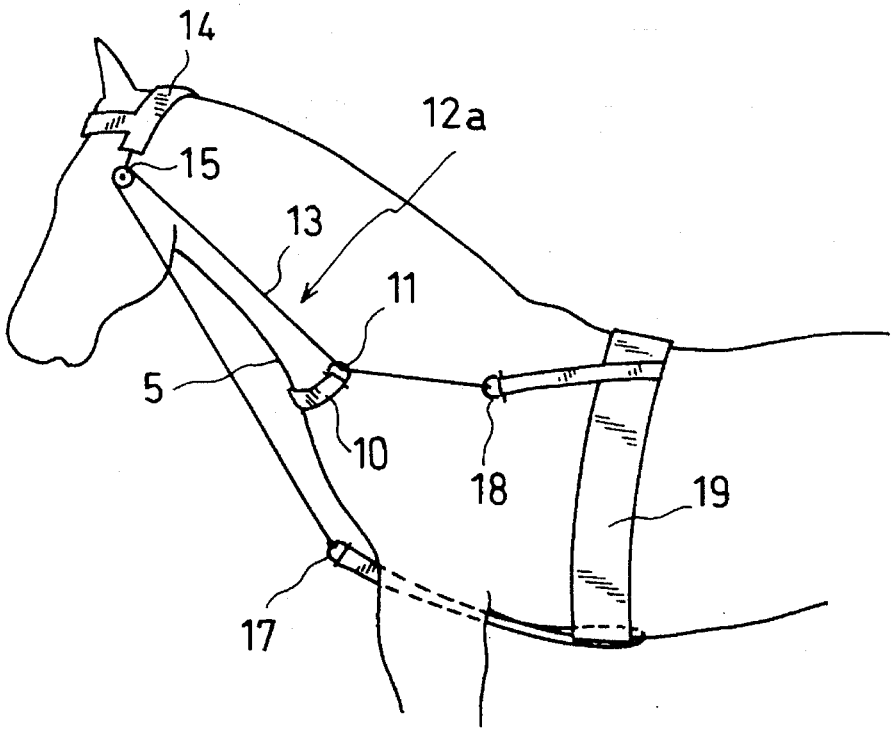
FIG. 2 shows a horse in profile, equipped with the apparatus according to a first embodiment.
Figure 3:
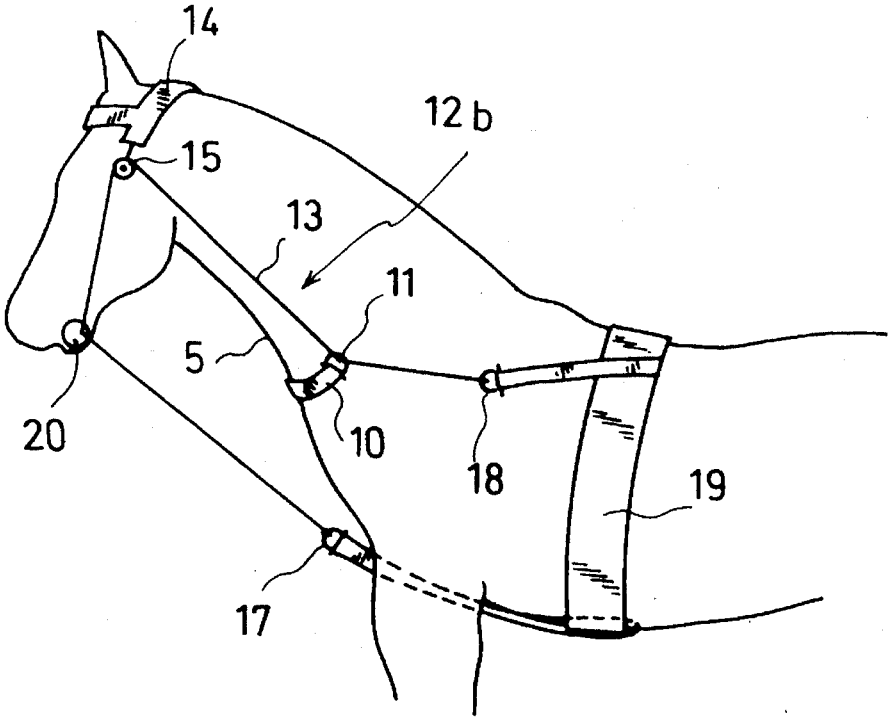
FIG. 3 shows a variant of this first embodiment.

Referring now to FIGS. 2 and 3, these describe a first embodiment of the apparatus. These two figures show a gymnastic harnessing and guiding apparatus for a horse, which apparatus comprises at least one stimulation member 10 placed at the lower part of the horse's neck 5 and means 12*a*, 12*b*, for recalling said member upwardly and rearwardly. Said stimulation member 10 is designed to exert an annoying stimulation at the lower part of the horse's neck 5, in a region situated between the third cervical vertebra and the first dorsal vertebra, as soon as the posture of the horse's neck 5 departs from a target posture A0 to beyond a predetermined lower limit.

The figures show a horse in profile equipped with a gymnastic harnessing apparatus, therefore only one side of the apparatus can be seen. Thereafter, the various "first" members or fixing points described will be situated on the first side of the horse while the various "second" members or fixing points will be situated on the second side of the horse.

The apparatus comprises first and second sliding members 11 situated on either side of the horse's neck 5. The stimulation member 10 is placed between the first and second sliding members 11 on the neck.

The recalling members 12*a*, 12*b* comprise at least a flexible strap 13, a headstall 14 having first and second head-recalling members 15 respectively placed on each one of its lateral ends, a breast-recalling member 17, as well as first and second fixing points 18 on the shoulders, respectively placed on each side of the horse, in a region situated between the shoulders and the withers. The strap 13 is joined by a first end to the first fixing point 18 on the shoulder, it passes successively through the first sliding member on the neck, through the first head-recalling member 15 and through the breast-recalling member 17. The second side of the horse is not visible, but by symmetry, it is understood that the same strap 13, or another similar strap, fixed to the breast-recalling member, then passes through the second head-recalling member, through the second sliding member on the neck and is joined to the second fixing point on the shoulder by its second end.

The recalling members can be sliding members or fixing members.

The fixing points 18 on the shoulders can be constituted by a buckle placed at the front end of the straps which are fastened to a surcingle 19 by their back end. Similarly, the breast-recalling member can be constituted by a ring fastened to the front end of a strap joined to the surcingle under the breast. If the horse carries a saddle, the strap of that saddle can act exactly like the surcingle 19.

FIG. 3 shows that the horse is equipped with a bit of which the ends have first and second sliding members 20 on that bit. In this variant, the strap 13 passes through the first bit sliding member 20 on the bit between the first head-recalling member 15 and the breast-recalling member 17. On the other side of the horse, said strap passes through the second sliding member on the bit between said breast-recalling member 17 and the second head-recalling member. In the variant illustrated in said figure, at least the head-recalling members are sliding members.

In said two figures, it is noted that the stimulation member is constituted of a strap 10 of which the ends are respectively fixed to the first and second sliding members 11 on the neck.

Figure 5:
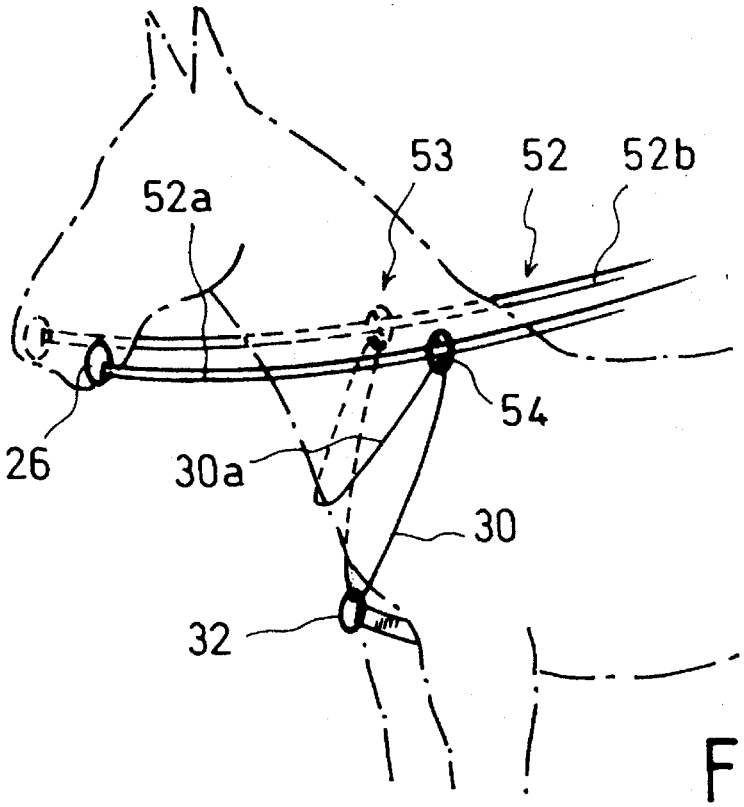
FIG. 5 shows a first variant of said second embodiment.

Understandably, it is also possible to use a flexible strap 30 of the type shown in FIG. 5. Said strap passes through the first and second sliding members on the neck and through the breast-recalling member 17, which in this case is a sliding member. It is the upper end 30*a* of said strap 30 joining together the first and second sliding members 11 on the neck, which constitutes the stimulation member. As shown in FIG. 5, the ends of said strap can be joined, but it is also possible to use a strap of the type illustrated in FIG. 6 by joining their ends to the bit sliding members 20 illustrated in FIG. 3.

A second embodiment of the apparatus will now be described, more particularly intended for the gymnastic training of a mounted horse.

Figure 4:
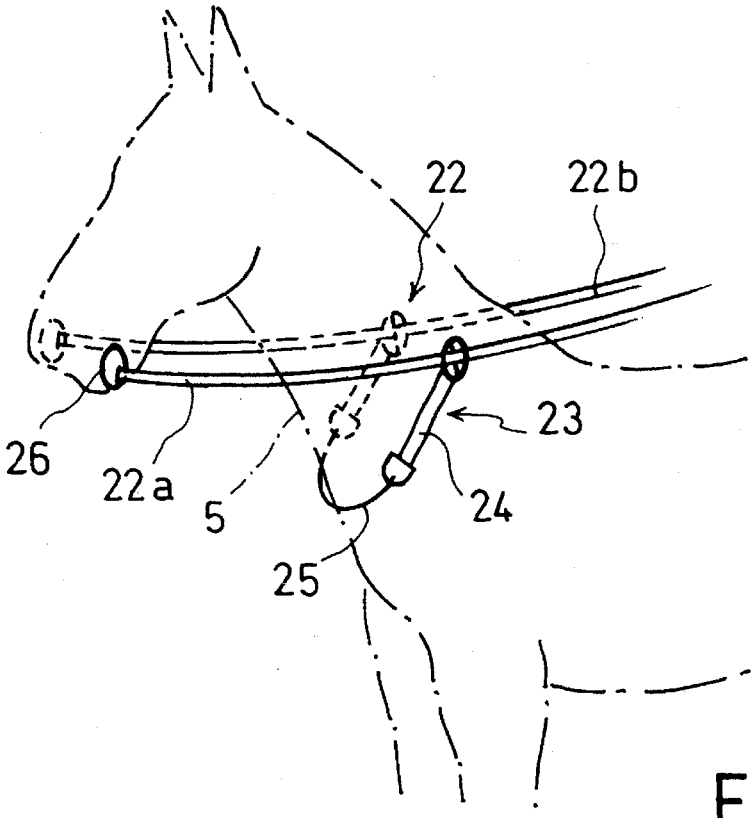
FIG. 4 shows a second embodiment of the invention.

In FIG. 4, the horse is equipped with guiding reins 22. The upwards and rearwards recalling means 23 comprise two straps 24 joined to the reins on either side of the neck 5 of the horse and separating said reins 22 into a first part 22*a* situated on the side of the bit 26 and into a second part 22*b* situated in the direction of the rider.

Figure 7:
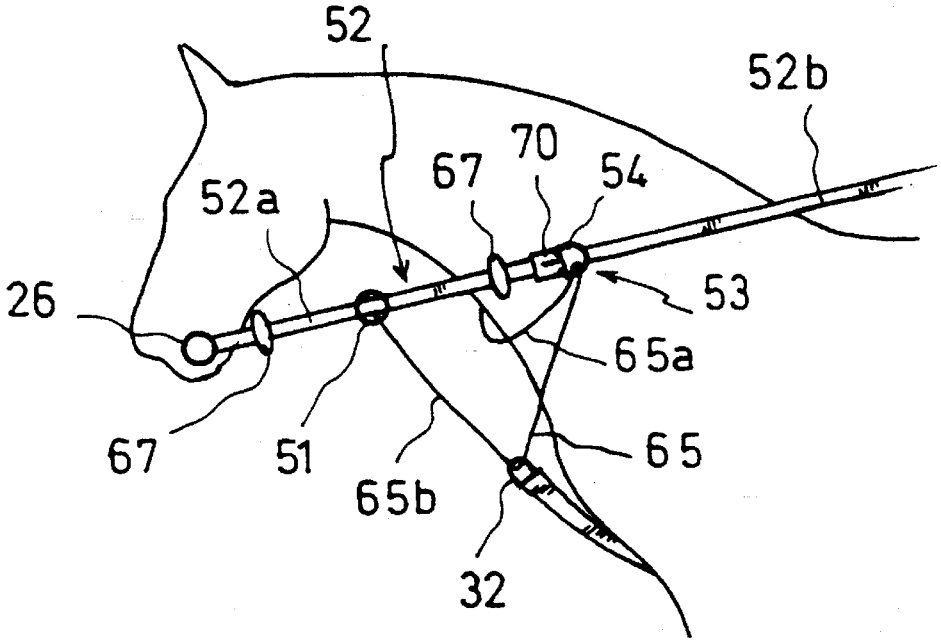
FIG. 7 shows a third variant.

FIGS. 5 and 7 illustrate another variant of embodiment of the upwards and rearwards recalling means 53. In this variant, the horse being equipped with guiding reins 52, said upwards and rearwards recalling means 53 comprise first and second buckles 54 separating the reins into a first part 52*a* situated on the side of the bit 26 and into a second part 52*b* situated in the direction of the rider. In FIG. 7, the apparatus is shown to comprise means 70 for adjusting the length of the two parts of the reins, which means comprise for example a system with buckles.

All these figures show that the apparatus comprises a flexible strap, respectively designated by references 25, 30, 35, and 65, of which at least one part is situated across the lower part of the horse's neck, between at least part of the upwards and rearwards recalling means. This part constitutes the stimulation member.

Figure 6:
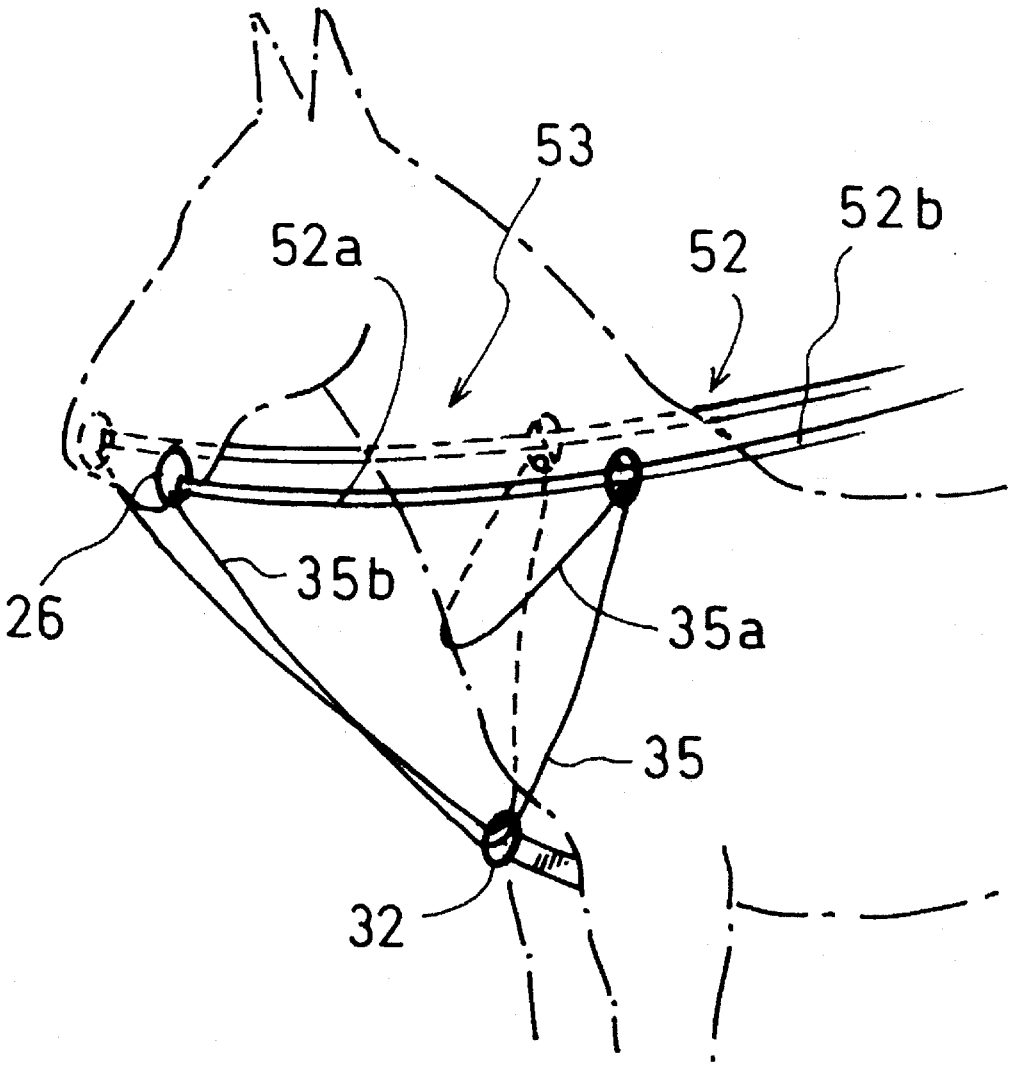
FIG. 6 shows a second variant.

The flexible strap advantageously passes through first and second sliding members on the neck. FIGS. 5 to 7 show that said neck sliding members can be directly constituted by the buckles 54. Accordingly, the strap 30, 35, 65 passes through the buckles 54, or at least through snap hooks (not shown) fastened to said buckles, and slides freely therein so that it is the part 20*a*, 35*a*, 65*a* of the strap situated between said buckles 54 which constitutes the stimulation member.

As indicated in these figures, the strap then passes through a sliding member 32 on the breast.

Although FIG. 7 only shows one side of the apparatus, it is understood that the flexible strap 65, passes through the first and second buckles 54, if necessary via snap hooks, and through the sliding member 32 on the breast.

FIG. 6 shows a coercive variant in which the two ends 35*b* of the strap 35 are joined to the bit on either side of the horse's mouth. In this figure, the ends 35*b* of the strap directly join the bit to the sliding member 32 on the breast. It is easily conceivable that the ends of the strap are joined to the bit by passing once more through the sliding members on the neck i.e., if necessary, through the buckles 54.

Moreover, as shown in FIG. 5, the strap 30 can be closed over itself.

FIG. 7 shows a variant embodiment, in which the strap 65 passes through the buckles 54, through the sliding member 32 on the breast and has ends 65*b* which, on either side of the horse's head, are joined to the reins 52 on their first part 52*a*. The joining of the strap on the first part of the reins is achieved via a joining member 51, constituted for example by a simple ring. The ring 51 is advantageously mounted for sliding on the first part of the reins, and its sliding amplitude can be limited by stop buttons 67.

The apparatus can comprise a flexible strap similar to strap 30 in FIG. 5 as well as the abovesaid buckles 54, but it can also have sliding members on the neck which are constituted by two buckles dissociated from the buckles 54. The upwards and downwards recalling means can also comprise, on each side of the neck, a recalling strap fixed by a first end to the first sliding member on the neck, going through a first buckle 54, and being joined to the reins on their first part 52*a*, for example by means of the ring 51.

The variants which have just been described with reference to FIGS. 5 to 7, using a flexible strap disposed in triangle fashion between sliding members on the neck and a sliding member on the breast, have the advantage of not impeding the lateral guiding of the horse by the action of the reins on the bit. Indeed, for guiding the horse towards the first side, it suffices to pull the rein of that first side, while relaxing the other rein, the effect of this being to cause the strap to slide through the different sliding members, while shortening the portion of strap included between the sliding member on the breast and the second sliding member on the neck and while lengthening the other portions.

Figure 8:
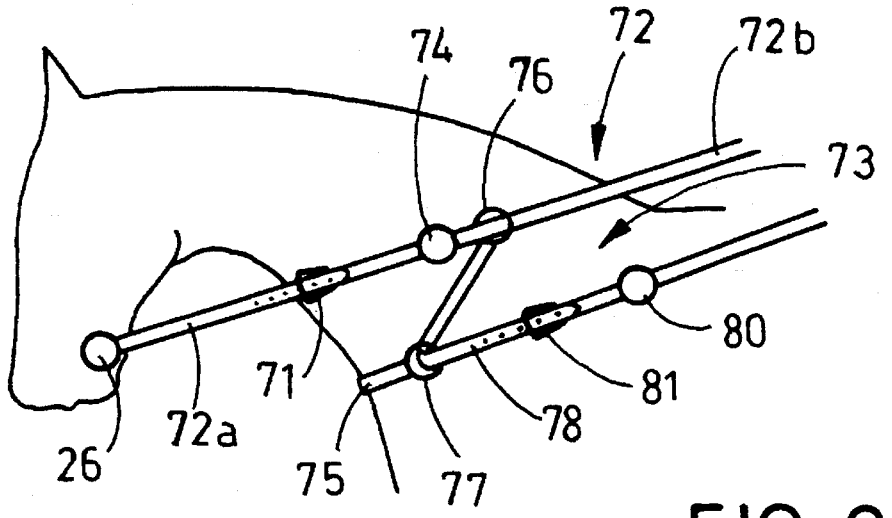
FIG. 8 shows a fourth variant.

FIG. 8 shows a variant which uses a stimulation member 75, similar to that shown in FIGS. 2 and 3, designated in these figures by reference 10. Each rein 72 is divided into two parts 72*a* and 72*b* by a ring 74. The lengths of the front part 72*a* can be adjusted by means of a control buckle 71. The ring 74 is fixed and acts as a front stop for a sliding ring 76.

On either side of the neck, the upwards and rearwards recalling means 73 comprise a flexible strap 78, the sliding ring 76 and an upper fixed point 80, situated substantially at the level of the withers. This upper fixed point is for example constituted by a fixed ring joined to the saddle, to the surcingle or to a straddling piece on the neck.

The strap 78 passes successively through the sliding ring 76, through the sliding member 77 on the neck and through the upper fixed point 80. The length of said strap can be adjusted by means of a control buckle 81.

In FIG. 8, the ends of the strap 78 are respectively fixed to the sliding ring 76 and to the upper fixed point 80.

It is also possible, in order to obtain a double pulley effect, to adopt a slightly different variant, consisting in fixing the first end of the strap to the sliding ring 76, and to cause it to pass successively through the member 77 and the ring 80, before causing it to return to the member 77 to finally fix thereon its second end or to cause it to join up with the second end of the similar flexible strap, situated on the other side of the neck, and to fix it to the latter.

According to another embodiment, not shown, and intended to be used on a horse equipped with guiding reins, the apparatus comprises a flexible strap of which the two ends are joined to the reins on either side of the horse's neck, and of which the middle part forms a buckle designed to be passed around the horse's neck, and crossed over on the lower part of the neck in order to produce the stimulation member.

What is claimed is:

1. A gymnastic harnessing and guiding apparatus for a horse, comprising:

at least one stimulation member adapted to be placed at a lower part of the horse's neck; and means for recalling said at least one stimulation member upwardly and rearwardly, said recalling means further comprising:

a flexible strap, a headstall comprising first and second head-recalling members, respectively placed on each one of its lateral ends, a breast-recalling member, and first and second shoulder fixing points, respectively configured for placement on each side of the horse between the shoulders and the withers;

said at least one stimulation member being designed to exert an annoying stimulation at the lower part of the horse's neck, in a region situated between the third cervical vertebra and the first dorsal vertebra, as soon as the position of the horse's head and neck departs from a target position to beyond a predetermined lower limit, said at least one stimulation member being placed between first and second sliding members adapted to be situated on either side of the horse's neck, said flexible strap being joined by a first end to the first shoulder fixing point, and passing successively through the first sliding member, the first head-recalling member, the breast-recalling member, the second head-recalling member, and the second sliding member, and being joined to the second shoulder fixing point by its second end.

2. Apparatus as claimed in claim 1, designed to be used on a horse equipped with a bit of which the ends have first and second sliding members, wherein the flexible strap passes through the first sliding member on the bit, between the first head-recalling member and the breast-recalling member, and through the second sliding member on the bit between said breast-recalling member and the second head-recalling member.

3. Apparatus as claimed in claim 1, wherein said at least one stimulation member is constituted by a stimulation strap having ends respectively fixed to the first and second sliding members.

4. Apparatus as claimed in claim 1, wherein said apparatus comprises a flexible stimulation strap passing through the first and second sliding members and through the breast-recalling member, the upper end of said flexible stimulation joining together the first and second sliding members constituting said at least one stimulation member.

5. A gymnastic harnessing and guiding apparatus for a horse, comprising:

at least one stimulation member adapted to be placed at a lower part of the horse's neck;

means for recalling said at least one stimulation member upwardly and rearwardly, said recalling means further comprising:

a first flexible strap, a first sliding ring and a first upper fixed point, configured for placement on a first side of the horse's neck, and a second flexible strap, second sliding ring and a second upper fixed point, configured for placement on a second side of the horse's neck; and front stop means for said first and second sliding rings;

said at least one stimulation member being designed to exert an annoying stimulation at the lower part of the horse's neck, in a region situated between the third cervical vertebra and the first dorsal vertebra, as soon as the position of the horse's head and neck departs from a target position to beyond a predetermined lower limit, said at least one stimulation member being placed between first and second sliding members adapted to be situated on either side of the horse's neck, said first and second upper fixed points being adapted to be situated substantially at the level of the withers, said first flexible strap being joined to the first sliding ring, passing through the first sliding member and to the first upper fixed point, said second flexible strap being joined to the second sliding ring, passing through the second sliding member and to the second upper fixed point.

6. Apparatus as claimed in claim 5, designed to be used on a horse equipped with guiding reins adapted to be situated on either side of the horse's neck, wherein each of said reins is separated into a first part situated on the side of the bit and a second part situated in the direction of a rider by separating means, and wherein said separating means act as a front stop for the sliding ring.

7. Apparatus as claimed in claim 6, wherein the length of the first part of each rein is adjustable.

8. A gymnastic harnessing and guiding apparatus for a horse equipped with guiding reins, comprising:

at least one stimulation member adapted to be placed at a lower part of the horse's neck;

means for recalling said at least one stimulation member upwardly and rearwardly, said recalling means further comprising:

first and second sliding members adapted to be situated on either side of the horse's neck, said first and second sliding members separating each rein into a first part situated on the side of a bit and a second part situated in the direction of a rider, and a third sliding member configured for placement on the horse's breast;

said at least one stimulation member comprising a flexible strap passing through said first and second sliding members and through said third sliding member.

9. Apparatus as claimed in claim 8, wherein the two ends of the flexible strap are joined to the bit.

10. Apparatus as claimed in claim 8, wherein the ends of the flexible strap are joined to the reins on the first part thereof.

11. Apparatus as claimed in claim 8, wherein said first and second sliding members comprise first and second buckles.

12. Apparatus as claimed in claim 8, wherein the length of the two parts of each rein is adjustable.

* * * * *